United States Patent [19]

Haas et al.

[11] Patent Number: 4,558,863

[45] Date of Patent: Dec. 17, 1985

[54] GOLF CLUB SHAFT

[75] Inventors: Steven L. Haas, Greer, S.C.; William Gobush, North Dartmouth, Mass.

[73] Assignee: Acushnet Company, New Bedford, Mass.

[21] Appl. No.: 386,439

[22] Filed: Jun. 8, 1982

Related U.S. Application Data

[63] Continuation of Ser. No. 222,080, Jan. 2, 1981, abandoned.

[51] Int. Cl.[4] ..... A63B 53/12

[52] U.S. Cl. ..... 273/77 A; 273/80 B

[58] Field of Search ..... 273/80 B, 77 A

[56] References Cited

U.S. PATENT DOCUMENTS

| | | | |
|---|---|---|---|
| 976,267 | 11/1910 | Knight | 273/80 B |
| 1,974,389 | 9/1934 | Cowdery | 273/80 B |
| 3,871,649 | 3/1975 | Kilshaw | 273/80 B X |
| 4,165,874 | 8/1979 | Lezatte | 273/80 B X |
| 4,169,595 | 10/1979 | Kaugars | 273/80 R |
| 4,288,075 | 9/1981 | Kaugars et al. | 273/80 B |

FOREIGN PATENT DOCUMENTS

| | | | |
|---|---|---|---|
| 1262896 | 2/1972 | United Kingdom | 273/80 B |
| 1286255 | 8/1972 | United Kingdom | 273/80 B |

OTHER PUBLICATIONS

"The Search for the Perfect Swing", by Cochran and Stobbs; 1968: pp. 211 and 212.

"Golf Digest"; Mar. 1972; p. 10.

*Primary Examiner*—George J. Mario

*Attorney, Agent, or Firm*—Lucas & Just

[57] ABSTRACT

A method of configuring a stepped, cylindrical golf club shaft to achieve an optimum shaft impact angle is diclosed. A predetermined portion in the middle of the shaft is selected as are the number of steps to be used, the wall thickness of each step and the outer diameter. For each configuration which has the selected number of steps the deflection at a predetermined point is calculated when a load is applied at another point. For those deflections which fall within a desired predetermined range of deflections, the slope of the bending angle of the shaft is calculated at the point of deflection. A configuration is then selected which has a desired slope and a golf club shaft is made with the middle portion configured to provide the desired bending angle. Specific configurations for maximum bending angle are provided for both wood-type and iron-type golf clubs.

7 Claims, 6 Drawing Figures

ALGORITHM FOR SHAFT OPTIMIZATION PROGRAM (Sheet 1)

(Sheet 2)

GOLF CLUB SHAFT

This is a continuation of application Ser. No. 222,080, filed Jan. 2, 1981, now abandoned.

The invention relates to an improvement in golf club shafts of the type having stepped cylindrical sections. The improvement relates to the bending angles and the flexibility of the golf club shaft.

Golf clubs are manufactured to have a range of sizes, weights, stiffnesses or flexibilities, loft angles of the club heads, and appearances as determined by and corresponding to the predilections and the scientific and aesthetic ideas of golfers and golf club manufacturers. A large number of choices among various parameters are combined within a finished golf club. These parameters affect the feel of the club to the golfer while influencing the trajectory of a golf ball.

Many golfers have a problem in driving a golf ball so that it has a desirably high trajectory or, sometimes, even in getting the golf ball airborne. Their problems may be caused by many factors, but it has been found that one of the important contributing factors is the control of the effective loft angle of the club head face as it strikes the golf ball.

Conventionally, each golf club head is manufactured to have a face having a predetermined loft angle. This loft angle is well known and defined as the angle that the face of the club head makes with reference to a vertical axis as the golf ball is addressed.

The angle from the vertical at which the face of the club head lies is also well known, and is known as the impact angle. It would be thought that all other things being equal, this would be an angle less than the loft angle since the club is being swung through an arc with a flexible shaft. However, it has been found that, contrary to the club head lagging behind, the club head usually advances ahead of where it would be expected to be based on the loft angle. The reason for this advance is not fully understood but it is believed to involve the momentum of the club head and the particular flexibility of a golf club shaft. The angle to which the shaft bends forward at the time of impact as opposed to an imaginary straight line corresponding to the center line of the shaft is defined as the shaft impact angle. The launch angle of the golf ball after being struck by the club head is dependent, among other things, upon the effective loft angle of the club face as created by the summing of the loft angle of the club head with the shaft impact angle. All other things being equal, the greater the effective loft angle, the higher the trajectory of the flight. Thus, the greater the shaft impact angle, the better the chance for a higher trajectory flight.

The shaft impact angle may be increased by increasing the flexibility of the club shaft; highly flexible club shafts develop a large curvature during the swing. The subjective feel of the golf club to the golfer, however, also corresponds in a measure to the flexibility of the golf club shaft. Further, in trying to attain greater shaft impact angles and higher trajectory flights with such flexible shafts, the associated whippiness of the shaft can cause the golfer to suffer loss of some control and creates a greater chance for error in placement of the club head as it strikes the ball.

It has been discovered that, for a specified, delimited range of flexibilities of shafts having cylindrical steps there are associated a plurality of various configurations of these cylindrical steps, each variation having a different impact angle. A method has been discovered for configuring the cylindrical steps in a selected portion of the shaft to obtain substantially the maximum impact angle in a shaft within a predetermined flexibility range. The method is applicable to both woods and irons.

Other criteria, of course, may be desirable and useful in addition to the criteria of maximum impact angle for selection of a final configuration. Also the ends of the shaft may be trimmed to provide leeway in length and flexibility of the club. Further features and objects of the invention will be noted from the following detailed description of the invention and accompanying figures wherein.

Figure 1:
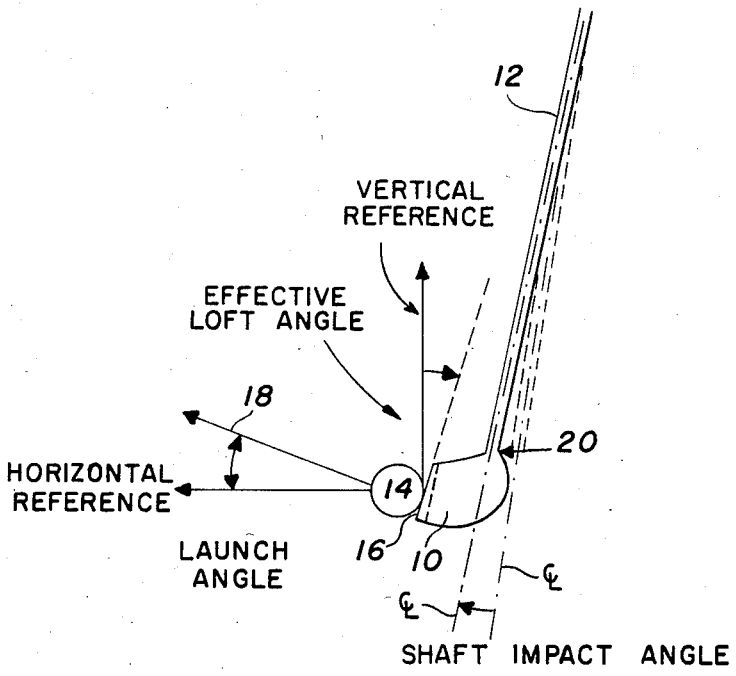
FIG. 1 is an illustration of the various angles involved in the impact of a club head with a golf ball.

FIG. 1 is an illustration of the various angles associated with the interaction of a golf club head and a golf ball at the time of impact. A golf club head 10 is attached in conventional manner to a flexible golf club shaft 12. A golf ball 14 is shown instantaneously in contact with the face 16 of the club head 10.

Upon impact of the golf ball 14 with the face 16 of the club head 10, the golf ball moves along the line 18 which makes an angle with the horizontal as illustrated in the figure. The angle is termed the launch angle of the golf ball.

The dashed lines in the figure represent the shaft position and club face position as they would be while the golf ball 14 is addressed, i.e., with the club at rest against the ball. In this club position, the angle of the club head face 16 to the vertical is termed the loft angle of the club face. As illustrated, the club head 10 and the lower portion of the shaft are shown advanced from the address position shown in dashed lines. The angle that the tip end of the shaft 20 makes at impact to the shaft in the rest position, is termed the shaft impact angle. It is clear that the effective angle the club face 16 makes in its contact with the ball, corresponds in part, to the sum of the shaft impact angle and the loft angle of the club face 16. The angle of the club face with respect to the vertical under these dynamic conditions is termed the effective loft angle of the golf club head. Other things equal, the greater the impact angle, the higher the initial launch angle of the golf ball.

Figure 2:
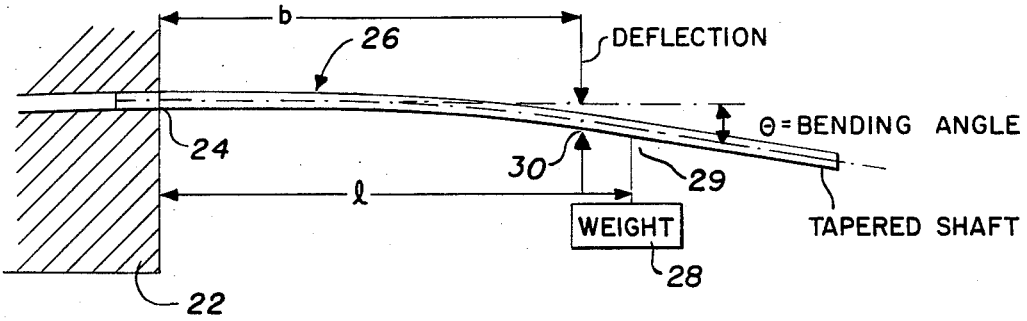
FIG. 2 illustrates the bending angle and stiffness test for a shaft.

In many cases the angles described above are dependent upon the characteristics and positioning of the golfer using the club. In order to avoid the subjectivity associated with individuals, conventionally standardized measurements of the flexibility of a golf club shaft are made. FIG. 2 shows a schematic representation of a test fixture for making such standardized measurements.

In FIG. 2, a rigid support frame 22 supports one end 24 of a golf club shaft 26 to be tested. Conveniently the grip end is clamped so that deflection of approximately the first 3" of the butt end portion is prevented. A weight 28 is fixed at a predetermined point near the tip end of the shaft 26 a distance from the butt end. The actual deflection of the shaft, measured at another predetermined point 30 a preselected distance b from the butt end, is a conventional measure of the flexibility of the golf club shaft 26. At this same point 30, the slope of the shaft 26 with respect to the horizontal may be measured. This slope is denoted as the bending angle of the golf club shaft. The measured static bending angle of the shaft 26 may be related to the dynamic shaft impact angle in a manner well known in the art. The greater the bending angle of the shaft, the greater the impact angle under dynamic conditions.

It has been discovered that, associated with a predetermined range of deflections at the point 30, in a stepped cylindrical shaft there is a range of bending angles which vary depending upon the actual configuration of the steps. There is thus a configuration of these steps for which there is a maximum bending angle. However, this maximum cannot be easily or directly determined because of the complexity and number of the possible configurations of the golf club shaft. The applicant has discovered a method for configuring the golf club shaft in order to assure obtaining a maximum bending angle for a predetermined flexibility of the shaft.

Figure 3:
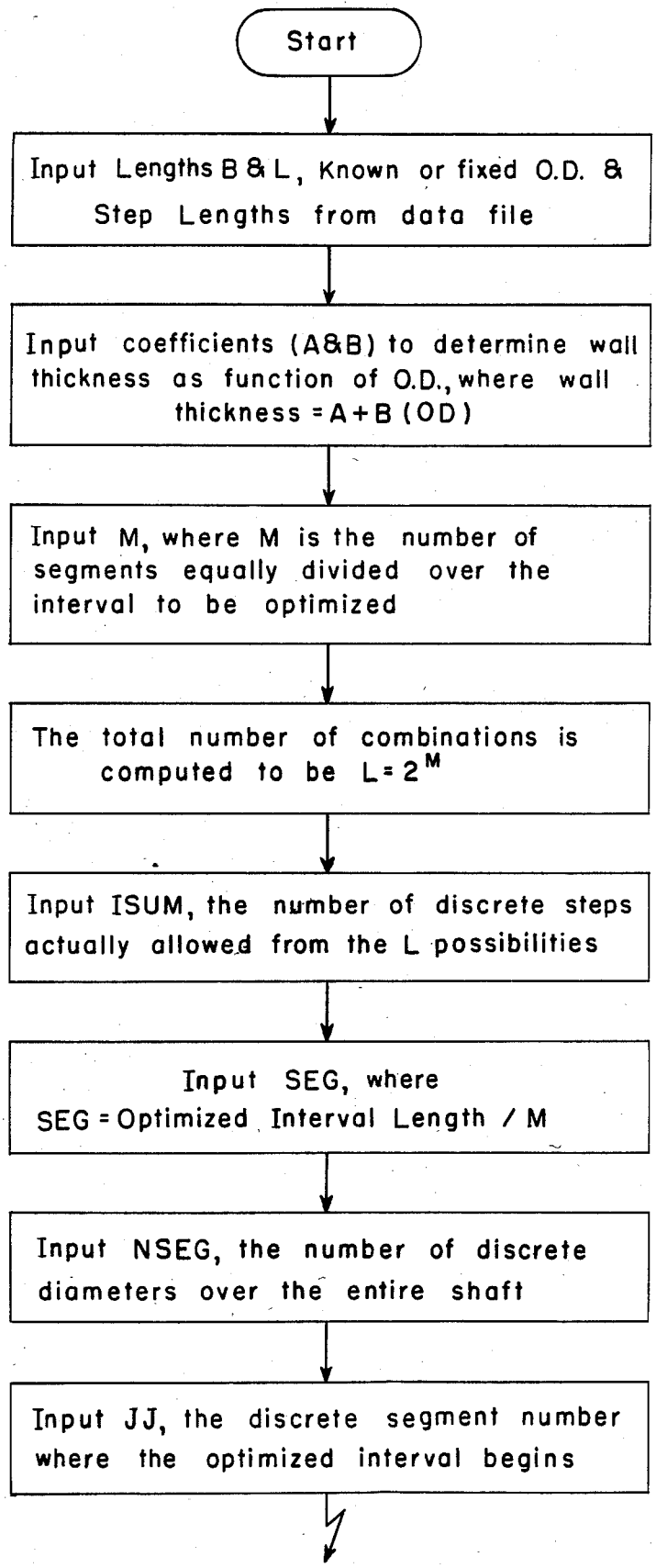
FIG. 3 is a flow diagram showing the steps required in the process for configuring a shaft according to the invention.
Figure 3:
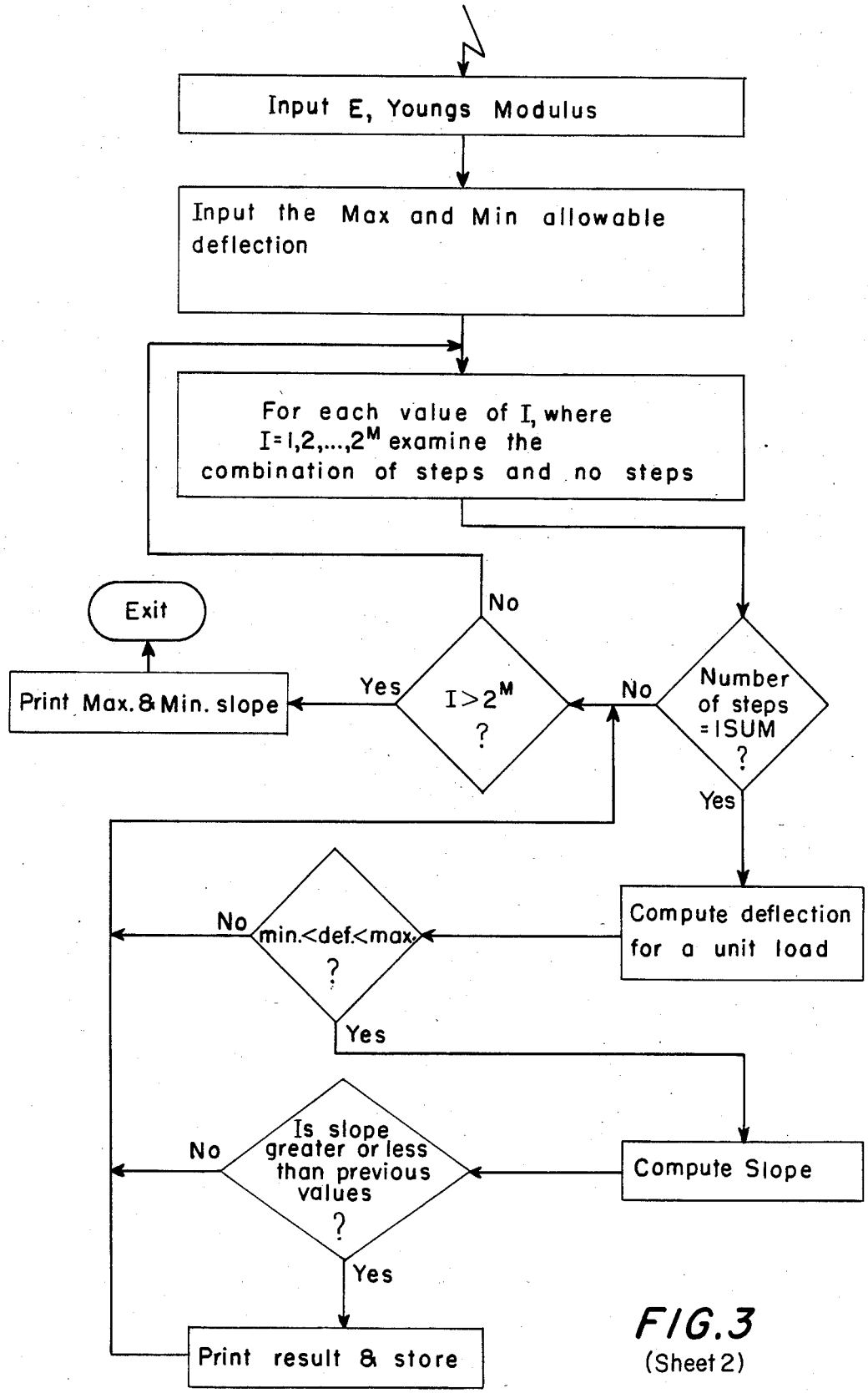

FIG. 3 is a flow chart of the method according to the invention for configuring a stepped cylindrical shaft to have the maximum bending angle for a given range of flexibility. As can be seen from FIG. 3, the method according to the invention requires the input of a plurality of preselected parameters.

The designer first selects the total length of the portion to be optimized. Shafts generally range from about 36 inches to 42 inches for irons and from about 40 inches to about 46 inches for woods. With either type of club, however, it has been found desirable to have a grip area of about 10 inches and a tip end length of about 14 inches of preselected configuration. Therefore, the portion to be optimized will generally be a middle portion having an upper length of from about 12 inches to about 22 inches. It has been found, however, that optimizing about 10 inches out of the middle portion of the shaft gives excellent results in accordance with the present invention.

The first step in the method according to the flow chart of FIG. 3 is the selection of the distances b and l from butt end of the shaft to the points 30 and 29 respectively, wherein b is the distance from the butt end to the point where the deflection is measured and l is the distance to the point where the load is applied.

The next step in the method according to the flow chart of FIG. 3 is the selection of step lengths and outside diameters of portions of the shaft outside the middle portion to be optimized. The portion to be optimized is then divided into a number of equal length segments over the portion. The number of segments is represented in FIG. 3 by the letter M.

The total number of discrete steps which are to occur within the optimized portion is selected. ISUM stands for this chosen number of steps. Conveniently, a step is always assumed to exist between the last segment of the optimized portion and the next successive section.

The outside diameters of the discrete steps are then defined to provide specified stepped reductions from one end to the other of the optimized portion. Wall thickness is assumed to correspond directly to the outer diameter of each section.

The choice of M and the length of the optimized portion determines the length of each segment within the portion to be optimized. In the flow chart of FIG. 3, SEG stands for the length of each segment. NSEG stands for the number of discrete sections in the entire shaft. JJ stands for the number of the section on which the optimized portion is to begin. According to the flow chart of FIG. 3, each of these parameters may be selected for input into the method according to the invention.

The known Young's Modulus of the selected material for the golf club shaft is input. In FIG. 3, E stands for Young's Modulus. The maximum and minimum allowable deflections are the final input parameters of the method according to the invention. These deflection ranges are selected as desired to correspond to conventional ranges of flexibility for conventional golf club shafts.

Figure 4:
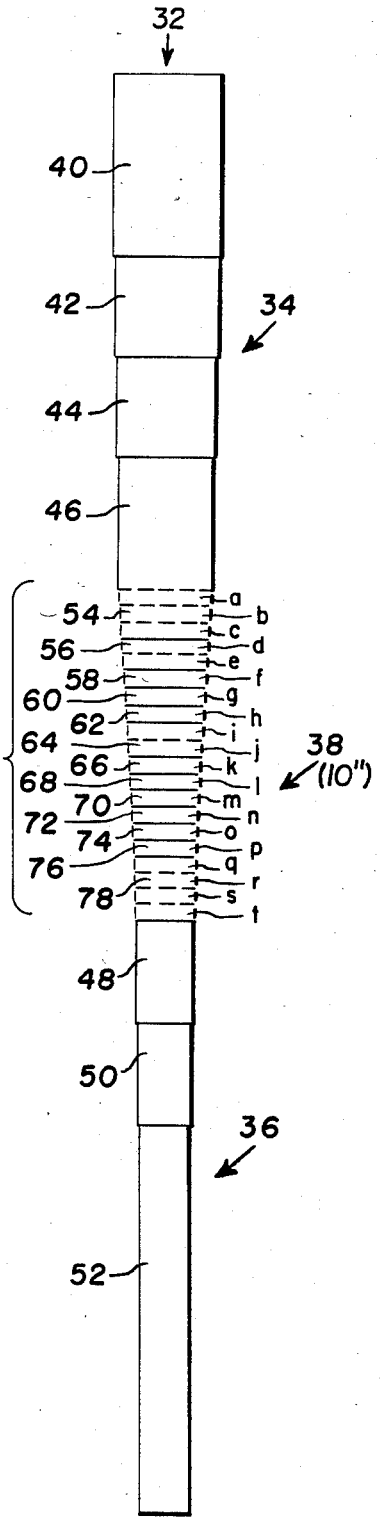
FIG. 4 is a generalized cylindrically-stepped golf club shaft to be configured by the method according to the invention.

A typical golf club shaft 32 having stepped cylindrical sections is shown in FIG. 4. The golf club shaft is shown divided into portions, one portion 34 at the grip end of the shaft, another portion 36 at the tip end of the shaft, and the portion to be optimized 38 between the two. As shown in FIG. 4, portion 34 consists of 4 cylindrical sections 40, 42, 44 and 46, each section being of varying length and the outer diameter of each successive section decreasing by a given amount. The portion 36 at the tip end is shown as having 3 sections 48, 50 and 52, each of varying length and decreasing diameter, respectively.

The portion 38 to be optimized is shown as consisting of 20 segments, a, b, c, etc., each having one-half-inch lengths and having a total of 13 stepped reductions between portion 34 and portion 36. The decision to be made is which of the 20 segments receives one of the steps and which do not. Obviously, other segment lengths and stepped reductions may be utilized in the method disclosed herein.

The example below illustrates the steps to be followed in configuring a golf club shaft of FIG. 4 according to the method of the invention as illustrated in the flow chart of FIG. 3.

TABLE 1

| Section No. | Outer Diameter (in) | Wall Thickness (in) | Length (in) |
|---|---|---|---|
| 40 | 0.62 | .0130 | 4 |
| 42 | 0.60 | 0.130 | 3 |
| 44 | 0.580 | .0135 | 3 |
| 46 | 0.560 | .0140 | 4 |
| 54 | 0.560 | .0140 | — |
| 56 | 0.545 | .0145 | — |
| 58 | 0.530 | .0145 | — |
| 60 | 0.515 | .0150 | — |
| 62 | 0.500 | .0150 | — to be |
| 64 | 0.485 | .0155 | — determined |
| 66 | 0.470 | .0160 | — |
| 68 | 0.455 | .0160 | — |
| 70 | 0.440 | .0165 | — |
| 72 | 0.425 | .0165 | — |
| 74 | 0.410 | .0170 | — |
| 76 | 0.395 | .0175 | — |
| 78 | 0.380 | .0175 | — |
| 48 | 0.365 | .0180 | 3 |
| 50 | 0.350 | .0185 | 3 |

TABLE 1-continued

| Section No. | Outer Diameter (in) | Wall Thickness (in) | Length (in) |
|---|---|---|---|
| 52 | 0.335 | .0190 | 13 |

A = 0.02506
B = −.01979
M = 20
SEG = 0.5 inch
NSEG = 19
JJ = 4
E ≃ 30 × $10^6$ psi
b = 42 inches
Maximum Deflection = 873 inches
Minimum Deflection = 825 inches Table 1 is a list of the initially chosen parameters in this example. As given in Table 1, the lengths, outer diameters and wall thicknesses of sections 40 through 46 and 48 through 52 in FIG. 4 are preselected. In addition, the outer diameter and wall thickness of each of the steps in the optimized portion are also preselected as inputs. In FIG. 4, the portion 38 to be optimized is presented by successive sections 54 through 78. The presence of a stepped reduction at each of the segments a, b, c, or t, however, is to be determined in order for the shaft to have a maximum bending angle.

The wall thickness is assumed to vary linearly with the outer diameter of the sections of the golf club shaft according to the formula:

$$\text{Wall thickness} = A + B\,X\,(\text{O.D.}) \qquad \text{Eq. 1}$$

wherein A and B are selected constants determined from and depending upon the desired wall thickness at the tip and the grip end of the golf club shaft, and O.D. is the outer diameter of each of the secitons 40 through 78, respectively.

In this example, A is chosen to be 0.02506 and B is −0.01979.

The portion to be optimized 38 is shown divided into 20 equal segments a, b, c, etc., so that for this example M=20. The total number of configurations in which a step or no-step can exist at the end of each segment is $2^{20}$ or 1,048,576 configurations.

As is evident from FIG. 4, however, the configuration of the segments in FIG. 4 can only allow a predetermined number of steps. In this example, the desired number of steps represented by ISUM, is 12 steps, i.e. ISUM=12.

For a 10-inch portion to be optimized and for M=20 the length of each segment is ½-inch so that SEG equals ½-inch; NSEG is 19, since there are 19 discrete steps over the entire shaft and JJ equals 4 since the configuring for optimization begins on the 4th section 46 (FIG. 4).

Out of the total numbers of possibilities for steps at the end of segments a through t, in this example, there are only 12 actual steps allowed in each configuration. A step is indicated by the figure −1 and a no-step at the end of a segment is represented by +1. In order to have a valid combination which has only 12 steps, the algebraic sum of the total of steps and no-steps in this case must equal −4, i.e. −12 (steps) plus +8 (no-steps) equals −4. It is evident that other preselected numbers of steps and total numbers of segments will yield another number for an allowable configuration.

In the method according to the invention, for each allowable combination, that is when the number of steps is equal to ISUM, the deflection at a predetermined point is computed for a load placed on the end of the shaft in the following manner:

Referring to FIG. 2, for a load 28 applied at a preselected distance from the fixed end 22, the deflection measured at a distance b can be calculated from the formula:

$$\delta = \int_0^b \frac{P(l-x)}{EI}(b-x)\,dx \qquad \text{Eq. 2}$$

wherein

δ is the deflection of the shaft
b is the distance of the point on the shaft where deflection is measured from the end of the grip end of the shaft
P is the load applied
l is the distance from the end of the grip end of the shaft to the point where the load is applied
E is the modulus of elasticity
I is the section moment of inertia
and x represents a point on the shaft.

Since I, the section moment of inertia, is different from each section, i.e., the diameter and wall thickness changes at each step, Eq. 2 must be integrated piecewise:

$$\delta = \frac{P}{E}\left\{\frac{1}{I_1}\left[blx - \frac{lx^2}{2} - \frac{bx^2}{2} + \frac{x^3}{3}\right]_0^{x1} + \frac{1}{I_2}\left[blx - \frac{lx^2}{2} - \frac{bx^2}{2} + \frac{x^3}{3}\right]_{x1}^{x2} \cdots\right\} \qquad \text{Eq. 3}$$

wherein δ, l, b, P, and E are defined above in Equation 2, $I_1$, $I_2$, . . . are, respectively, the section moments of inertia of successive sections of the shaft and $x_1$, $x_2$, . . . are, respectively, the distances from the end of the grip end of the shaft to the successive steps in the shaft.

Thus, $$\delta = \frac{P}{E}\left\{\frac{x_1}{I_1}B_1 + \sum_{i=2}^{n}\frac{x_iB_i - x_{i-1}B_{i-1}}{I_i}\right\} \qquad \text{Eq. 4}$$

wherein $$B_i = bl - \frac{lx_i}{2} - \frac{bx_i}{2} + \frac{x_i^2}{3}$$

δ, l, b, P, and E are defined as Equation 2 and $I_i$ is the section moment of inertia of the $i^{th}$ section, $x_i$ is the distance from the butt end of the shaft to the $i^{th}$ step, and n is the total number of sections wherein $x_n$=b.

The modulus of elasticity for most materials is readily obtainable and the methods for calculating the section moment of inertia are well known in the art. For this example a modulus of elasticity of the shaft material is assumed.

For a point 39 inches from the butt end, the predetermined limits for desired deflection in this example are assumed to be 0.873 inches maximum and 0.825 inch minimum for a 1 lb. load acting 43 inches from the butt end. When the calculated deflection of a particular configuration lies within these limits then the further calculation of the slope of the shaft of the same point is performed.

The slope $\theta$ at some point b of a beam having a load P applied at a distance l from the fixed end is $$\theta = \int_0^b \frac{P(l-x)}{EI}\,dx \qquad \text{Eq. 5}$$

wherein $\theta$ is the slope of the shaft measured at a point b and P, b, l, E and I are as defined in Eq. 2. Integrated piecewise:

$$\theta = \frac{P}{E}\left[\frac{lx_1 - \frac{x_1^2}{2}}{I_1} + \frac{\left(lx_2 - \frac{x_2^2}{2}\right) - \left(lx_1 - \frac{x_1^2}{2}\right)}{I_2} + \ldots\right] \qquad \text{Eq. 6}$$

wherein $\theta$ is defined as above in Equation 5

P, E, and l are as above in Equation 2

I, $I_2$, . . . and x, $x_2$, . . . are as defined above in Equation 3.

when $$A_i = lx_i - \frac{x_i^2}{2} \qquad \text{Eq. 7}$$

$$\theta = \frac{P}{E}\left\{\frac{A_1}{I_1} + \sum_{i=2}^{n}\frac{(A_i - A_{i-1})}{I_i}\right\}$$

wherein $A_i = lx_i - (x_i^2/2)$, $x_i$, $I_i$, and n are as defined above in Equation 4.

If the slope as calculated is higher than any of the previous slopes, then the result is selected and retained until a configuration is found for which a greater slope is obtained. Every possible combination of steps and no steps within the portion to be optimized is tested so that it is assured that the configuration having the highest bending angle will be obtained.

The final result is a representation of a configuration of steps and no steps at the end of each segment so that section lengths 54 through 78 as multiples of the segment lengths a, b, c, d, e, etc. are determined. Table 2 is a list of the steps as configured for the example chosen. The numeral +1 represents no-step from the previous segment and −1 represents a step.

TABLE 2

| a | b | c | d | e | f | g | h | i | j | k | l | m | n | o | p | q | r | s | t |
|---|---|---|---|---|---|---|---|---|---|---|---|---|---|---|---|---|---|---|---|
| +1 | +1 | +1 | −1 | +1 | −1 | −1 | −1 | −1 | +1 | −1 | −1 | −1 | −1 | −1 | −1 | −1 | +1 | +1 | +1 |

Table 3 shows the completion of the configuration of Table 1.

TABLE 3

| Section No. | Length (in) |
|---|---|
| 54 | 1.5 |
| 56 | 1.0 |
| 58 | .5 |
| 60 | .5 |
| 62 | .5 |
| 64 | 1.0 |
| 66 | .5 |
| 68 | .5 |
| 70 | .5 |
| 72 | .5 |
| 74 | .5 |
| 76 | .5 |
| 78 | 2.0 |

In this example the optimized configuration has a slope of 2.851 at 0.873" deflection for a one-pound load. Of course, any desired slope within the range may also be selected. Given the flow chart a computer program is, of course easily implementable by one skilled in the art so that a detailed program is not included herein.

Figure 5:
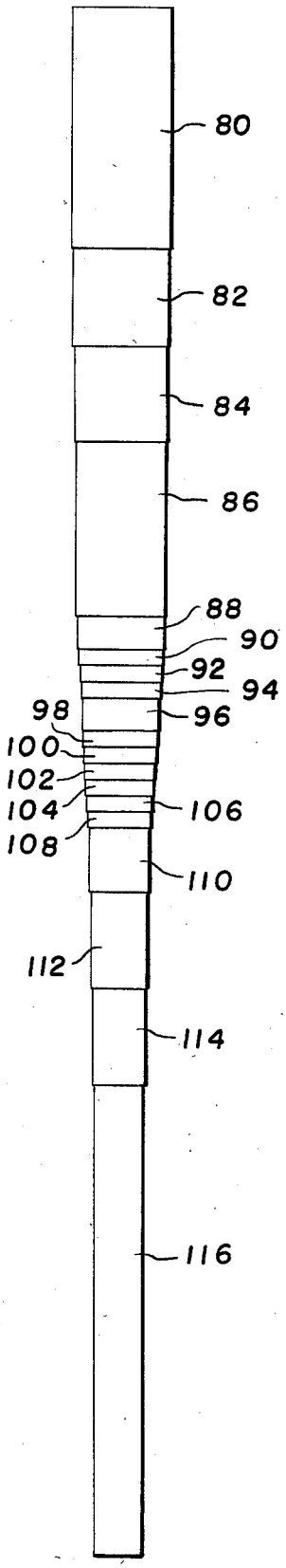
FIG. 5 is a preferred embodiment of a wood type shaft according to the invention.

FIG. 5 illustrates a wood type shaft configured with the aid of the method according to the invention. Table 4 shows the Outer Diameter wall thickness, and length of each section of FIG. 5.

TABLE 4

| Section | Length (in) | Outer Diameter (in) | Wall Thickness (in) |
|---|---|---|---|
| 80 | 4.5 | 0.620 | 0.0130 |
| 82 | 3.00 | 0.600 | 0.0130 |
| 84 | 3.00 | 0.580 | 0.0135 |
| 86 | 5.50 | 0.560 | 0.0140 |
| 88 | 1.00 | 0.545 | 0.0145 |
| 90 | 0.50 | 0.530 | 0.0145 |
| 92 | 0.50 | 0.515 | 0.0150 |
| 94 | 0.50 | 0.500 | 0.0150 |
| 96 | 1.00 | 0.485 | 0.0155 |
| 98 | 0.50 | 0.470 | 0.0160 |
| 100 | 0.50 | 0.455 | 0.0160 |
| 102 | 0.50 | 0.440 | 0.0165 |
| 104 | 0.50 | 0.425 | 0.0165 |
| 106 | 0.50 | 0.410 | 0.0170 |
| 108 | 0.50 | 0.395 | 0.0175 |
| 110 | 2.00 | 0.380 | 0.0175 |
| 112 | 3.00 | 0.365 | 0.0180 |
| 114 | 3.00 | 0.350 | 0.0185 |
| 116 | 12.50 | 0.335 | 0.0190 |

Figure 6:
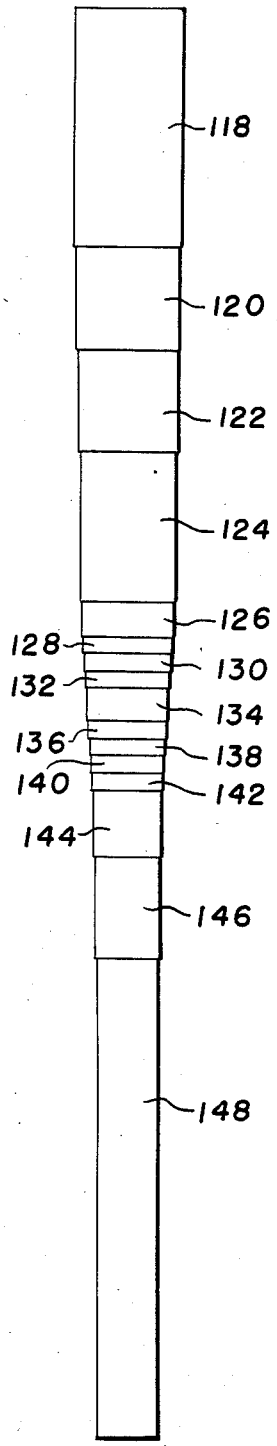
FIG. 6 is a preferred embodiment of an iron type shaft according to the invention.

FIG. 6 illustrates an iron type shaft configured with the aid of the method according to the invention. Table 5 lists the Outer Diameter wall thickness and length of each section of the shaft.

TABLE 5

| Section | Length (in) | Outer Diameter (in) | Wall Thickness (in) |
|---|---|---|---|
| 118 | 4.00 | 0.620 | 0.0135 |
| 120 | 3.00 | 0.600 | 0.0135 |
| 122 | 3.00 | 0.580 | |
| 124 | 4.50 | 0.560 | 0.0145 |
| 126 | 1.00 | 0.545 | 0.0150 |
| 128 | 0.50 | 0.530 | 0.0150 |
| 130 | 0.50 | 0.515 | 0.0155 |
| 132 | 0.50 | 0.500 | 0.0160 |
| 134 | 1.00 | 0.485 | 0.0160 |
| 136 | 0.50 | 0.470 | 0.0165 |
| 138 | 0.50 | 0.455 | 0.0170 |
| 140 | 0.50 | 0.440 | 0.0170 |
| 142 | 0.50 | 0.425 | 0.0175 |
| 144 | 2.00 | 0.410 | 0.0180 |
| 146 | 3.00 | 0.395 | 0.0180 |
| 148 | 14.00 | 0.370 | 0.0190 |

Table 6 is a computed theoretical comparison of the slope of a shaft configured according to the invention with a typical prior art shaft of conventional design for approximately equivalent stiffness. The letters S,R,A and L represent the conventional increasing flexibilities for golf clubs in the manner well known in the art.

TABLE 6

| Shaft | | | | |
|---|---|---|---|---|
| | According to Invention | Prior Art | Deflection (Inches) | Slope (Degrees) |
| Woods | (S) | | 0.810 | 2.652 |
| | | (S) | 0.802 | 2.503 |
| | (R) | | 0.873 | 2.851 |
| | | (R) | 0.869 | 2.732 |
| | (A) | | 0.993 | 3.120 |
| | | (A) | 0.990 | 2.999 |
| | (L) | | 1.093 | 3.401 |
| | | (L) | 1.079 | 3.253 |
| Irons | (S) | | 0.597 | 1.811 |
| | | (S) | 0.609 | 1.799 |
| | (R) | | 0.654 | 1.976 |
| | | (R) | 0.658 | 1.948 |
| | (A) | | 0.780 | 2.260 |
| | | (A) | 0.784 | 2.237 |
| | (L) | | 0.850 | 2.434 |
| | | (L) | 0.850 | 2.401 |

What is claimed is:

1. A method for making a stepped cylindrical golf club shaft of a desired material having a predetermined portion configured to achieve a predetermined shaft impact angle for a predetermined shaft flexibility for wood or iron type golf clubs, said predetermined portion lying within a middle portion of the shaft, said predetermined portion beginning no less than 10 inches from the grip end and ending at a point no less than 14 inches from the tip end of the golf club shaft comprising the steps of:

(a) selecting the length of said predetermined portion and the lengths of the portions of the shaft outside said predetermined portion;

(b) selecting a predetermined number of sections for the stepped golf club shaft outside the said predetermined portion and the lengths thereof;

(c) selecting the number of steps to be included in said predetermined portion;

(d) selecting the outer diameters and wall thicknesses of each section of the golf club shaft including the sections of said grip end, said tip end and said predetermined portion;

(e) dividing said predetermined portion into a plurality of equal segment lengths;

(f) determining from among the plurality of all combinations of steps or no steps at all the ends of each said segment, respectively, those combinations which have a configuration which has the selected number of steps;

(g) calculating, for each configuration having said selected number of steps, the deflection at a preselected point when a load is applied at another preselected point of a golf club shaft having such configuration, according to a first selected mathematical equation;

(h) selecting each of those configurations which have deflections within a desired predetermined range of deflections;

(i) determining, according to a second selected mathematical equation, at the point where deflection is calculated the slope of the bending angle of the shaft of each configuration with said desired predetermined range of deflections;

(j) selecting a configuration having the desired slope from among the plurality of configurations within said desired predetermined range of deflections; and (k) making a golf club shaft with the middle portion configured in accordance with the configuration selected in step j.

2. A golf club shaft made according to claim 1 having a maximum slope.

3. A golf club shaft made according to claim 1 having a minimum slope.

4. The method of claim 1 wherein the equal segment lengths of said predetermined portion are about one-half inch each.

5. A golf club shaft configured according to the method of claim 1.

6. In a shaft for a wood type golf club, said shaft having a length of from about 40 to 46 inches, the improvement comprising a center portion of said shaft of 10 inches in length and beginning no less than 10 inches from the grip end of the shaft and ending no less than 14 inches from the tip end of said shaft, said center portion having stepped cylindrical sections of the following successive dimensions:

| Section | Length (in) | Outer Diameter (in) | Wall Thickness (in) |
|---|---|---|---|
| 1 | 1.5 | 0.560 | .0140 |
| 2 | 1.0 | 0.545 | .0145 |
| 3 | .5 | 0.530 | .0145 |
| 4 | .5 | 0.515 | .0150 |
| 5 | .5 | 0.500 | .0150 |
| 6 | 1.0 | 0.485 | .0155 |
| 7 | .5 | 0.470 | .0160 |
| 8 | .5 | 0.455 | .0160 |
| 9 | .5 | 0.440 | .0165 |
| 10 | .5 | 0.425 | .0165 |
| 11 | .5 | 0.410 | .0170 |
| 12 | .5 | 0.395 | .0175 |
| 13 | 2.0 | 0.380 | .0175 |

7. In a shaft for an iron type golf club, said shaft having a length of from about 36 to 42 inches, the improvement comprising a center portion of said shaft of 10 inches in length and beginning no less than 10 inches from the grip end of the shaft and ending no less than 14 inches from the tip end of said shaft, said center portion having stepped cylindrical sections of the following:

| Section | Length (in) | Outer Diameter (in) | Wall Thickness (in) |
|---|---|---|---|
| 1 | 2.5 | 0.56 | .0145 |
| 2 | 1.0 | 0.545 | .0150 |
| 3 | .5 | 0.530 | .0150 |
| 4 | .5 | 0.515 | .0155 |
| 5 | .5 | 0.500 | .0160 |
| 6 | 1.0 | 0.485 | .0160 |
| 7 | .5 | 0.470 | .0165 |
| 8 | .5 | 0.455 | .0170 |
| 9 | .5 | 0.440 | .0170 |
| 10 | .5 | 0.425 | .0175 |
| 11 | 2.0 | 0.410 | .0180 |

* * * * *

UNITED STATES PATENT AND TRADEMARK OFFICE

CERTIFICATE OF CORRECTION

PATENT NO. : 4,558,863

DATED : December 17, 1985

INVENTOR(S) : Steven L. Haas et al.

It is certified that error appears in the above-identified patent and that said Letters Patent is hereby corrected as shown below:

Column 5, Table 1, line 12 thereof, delete the value of "873 inches" for the "Maximum Deflection" and substitute therefor --.873 inches--;

line 13 of Table 1, delete the value of "825 inches" for the "Minimum Deflection" and substitute therefor --.825 inches--.

Column 6, Equation 2, after the "equals" sign and before the "0" and the "b", insert an integral symbol, --∫--.

Column 6, Equation 3, after the first right square bracket, change "x1" to --$x_1$--; after the second right square bracket, change "x2" to --$x_2$-- and change "x1" to --$x_1$--.

Column 7, Equation 5, after the "equals" sign and before the "0" and the "b", insert an integral symbol, --∫--.

Signed and Sealed this

*Twentieth* Day of *May 1986*

[SEAL]

*Attest:*

DONALD J. QUIGG

*Attesting Officer*

*Commissioner of Patents and Trademarks*